US012012689B2

(12) United States Patent
Oak et al.

(10) Patent No.: US 12,012,689 B2
(45) Date of Patent: Jun. 18, 2024

(54) CLOTHING CARE SYSTEM

(71) Applicant: Samsung Electronics Co., Ltd., Suwon-si (KR)

(72) Inventors: Seong-Min Oak, Suwon-si (KR); Chul Kie Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 683 days.

(21) Appl. No.: 17/269,994

(22) PCT Filed: Aug. 6, 2019

(86) PCT No.: PCT/KR2019/009826

§ 371 (c)(1),
(2) Date: Feb. 19, 2021

(87) PCT Pub. No.: WO2020/040451

PCT Pub. Date: Feb. 27, 2020

(65) Prior Publication Data

US 2021/0324566 A1 Oct. 21, 2021

(30) Foreign Application Priority Data

Aug. 20, 2018 (KR) ..... 10-2018-0097011

(51) Int. Cl.
*D06F 58/10* (2006.01)
*D06F 58/24* (2006.01)
*D06F 73/02* (2006.01)

(52) U.S. Cl.
CPC ..... *D06F 58/10* (2013.01); *D06F 58/24* (2013.01); *D06F 73/02* (2013.01)

(58) Field of Classification Search
CPC ..... D06F 58/10; D06F 58/24; D06F 73/02
(Continued)

(56) References Cited

U.S. PATENT DOCUMENTS 3,651,580 A * 3/1972 Meyer ..... D06F 58/24 34/602
4,103,433 A * 8/1978 Taylor ..... D06F 58/20 165/909

(Continued)

FOREIGN PATENT DOCUMENTS

CN 109112808 B * 11/2021 ..... D06F 35/00
EP 3418437 A1 * 12/2018 ..... D06F 35/00

(Continued)

OTHER PUBLICATIONS

International Search Report of the International Searching Authority for International Application PCT/KR2019/009826 published Nov. 26, 2019, 5 pages.

(Continued)

*Primary Examiner* — Stephen M Gravini

(57) ABSTRACT

Disclosed is a clothing care system having an enhanced flow path structure. The clothing care system includes a main body including a clothing care room with an open front, a heat exchange device equipped in the main body and arranged to exchange heat with air in the clothing care room, and a door arranged to open or close the opening of the main body, wherein the door includes at least one dehumidification path allowing the clothing care room to be linked to outside, and wherein the dehumidification path comprises an inflow path arranged at the door to bring outside air into the clothing care room, and a discharge path arranged at the door to discharge air in the clothing care room to the outside.

13 Claims, 10 Drawing Sheets

(58) Field of Classification Search
USPC ..... 34/469, 595–610
See application file for complete search history.

(56) References Cited

U.S. PATENT DOCUMENTS

| | | | | |
|---|---|---|---|---|
| 7,093,374 | B2 * | 8/2006 | Yang | D06F 73/02 34/607 |
| 8,240,064 | B2 * | 8/2012 | Steffens | D06F 58/22 34/480 |
| 8,769,840 | B2 * | 7/2014 | Dondurur | D06F 58/20 68/19 |
| 9,334,603 | B2 * | 5/2016 | Oak | D06F 58/50 |
| 11,802,360 | B2 * | 10/2023 | Bocchino | D06F 58/22 |
| 2006/0059959 | A1 | 3/2006 | Je | |
| 2008/0136295 | A1 | 6/2008 | Aizpuru Borda et al. | |
| 2019/0024288 | A1 * | 1/2019 | Nam | D06F 58/203 |
| 2021/0324566 | A1 * | 10/2021 | Oak | D06F 58/24 |
| 2023/0235498 | A1 * | 7/2023 | Yeom | D06F 34/20 68/5 R |

FOREIGN PATENT DOCUMENTS

| | | | | | |
|---|---|---|---|---|---|
| JP | 2005040580 | A | * | 2/2005 | D06F 58/10 |
| KR | 10-2003-0094988 | A | | 12/2003 | |
| KR | 20050010415 | A | * | 1/2005 | |
| KR | 10-1108043 | B1 | | 1/2006 | |
| KR | 10-2006-0026193 | A | | 3/2006 | |
| KR | 10-2008-0109509 | A | | 12/2008 | |
| KR | 10-2009-0102401 | A | | 9/2009 | |
| KR | 10-2010-0121201 | A | | 11/2010 | |
| KR | 10-2014-0003984 | A | | 1/2014 | |
| KR | 10-1414635 | B1 | | 7/2014 | |
| KR | 10-1751777 | B1 | | 6/2017 | |
| KR | 10-2017-0128958 | A | | 11/2017 | |
| KR | 10-1867505 | B1 | | 6/2018 | |

OTHER PUBLICATIONS

Notice of Preliminary Rejection dated Jun. 9, 2023, in connection with Korean Application No. 10-2018-0097011, 16 pages.

* cited by examiner

CLOTHING CARE SYSTEM

CROSS-REFERENCE TO RELATED APPLICATIONS

This application is a 371 National Stage of International Application No. PCT/KR2019/009826 filed Aug. 6, 2019, which claims priority to Korean Patent Application No. 10-2018-0097011 filed Aug. 20, 2018, the disclosures of which are herein incorporated by reference in their entirety.

BACKGROUND

1. Field

The disclosure relates to a clothing care system, and more particularly, to a clothing care system with an enhanced flow path structure.

2. Description of Related Art

Clothing care systems generally refer to devices for handling clothes by washing or drying the clothes. Some clothing care systems with a drying function may include a hot air supplier for supplying hot air into an accommodating room for accommodating clothes to dry them, and a steam generator for performing a refresh function such as removing wrinkles, deodorizing, removing static electricity from the clothes.

The clothing care system is shaped like a cabinet with the accommodating room formed therein for accommodating clothes. The accommodating room for accommodating clothes is formed in an upper portion of the cabinet, and a machine room is arranged under the accommodating room to contain e.g., the steam generator or the hot air supplier. The accommodating room and the machine room may be separated by a partition wall.

The clothing care system dries clothes accommodated in the accommodating room by using the hot air supplier included in the machine room, and the air that becomes humid after drying the clothes is dehumidified by the hot air supplier and then supplied back into the accommodating room.

SUMMARY

An aspect of the disclosure provides a clothing care system that may have better performance by enhancing a flow path structure.

Another aspect of the disclosure provides a clothing care system that may have better dehumidification performance of the clothing care system.

Another aspect of the disclosure provides a clothing care system that is able to perform dehumidification while the door is closed, thereby having better indoor dehumidification performance.

An according to an aspect of the disclosure, a clothing care system includes a main body including a clothing care room with an open front; a heat exchange device equipped in the main body and arranged to exchange heat with air in the clothing care room; and a door arranged to open or close the opening of the main body, wherein the door includes at least one dehumidification path allowing the clothing care room to be linked to outside, and wherein the dehumidification path comprises an inflow path arranged at the door to bring outside air into the clothing care room, and a discharge path arranged at the door to discharge air in the clothing care room to the outside.

The inflow path may be arranged to release air, which flows into the door through a first inlet, into the clothing care room through a first outlet, and may comprise a first damper device arranged to open or close the first outlet.

The first damper device may include a first flow path open/close member arranged inside the inflow path and arranged to open or close the first outlet, and a first motor arranged to rotate the first flow path open/close member.

The clothing care system may further include a first circulation path arranged for air in the clothing care room to exchange heat with the heat exchange device and to be released into the clothing care room.

The clothing care system may further include a second circulation path arranged for air in the clothing care room to be filtered by a filter member and released into the clothing care room.

The second circulation path may include a wind blower device arranged to discharge air down or out of the clothing care room.

The main body may include a connection flow path arranged by being branched from the second circulation path to connect the second circulation path to the discharge path.

The connection flow path may be arranged between the second circulation path and the opening of the main body.

The connection flow path may include a second damper device arranged to be able to open or close a connection with the second circulation path.

The discharge path may be arranged to discharge air of the second circulation path, which is delivered to the connection flow path, out of the clothing care room through a second inlet and a second outlet.

The second inlet may be formed in a position corresponding to the connection flow path.

The door may include a first door member forming a front side, and a second door coupled with the first door member and forming a rear side, and the dehumidification path may be arranged between the first door member and the second door member.

The inflow path may include an inflow path duct installed on a rear side of the second door member.

The second door member may include a condensate water guide arranged to guide condensate water, and at least a portion of the inflow path duct may include the condensate water guide.

The clothing care system may further include a garment support member equipped in the clothing care room and arranged to support a clothe, and the second circulation path may be linked to the garment support member.

According to another aspect of the disclosure, a clothing care system includes a main body having a clothing care room formed therein; a door opening or closing the clothing care room; and at least one dehumidification path arranged in the door to link outside to the clothing care room, wherein the dehumidification path includes an inflow path arranged in the door to bring indoor air into the clothing care room and a discharge path arranged in the door to discharge air in the clothing care room to the outside of the clothing care room, to dehumidify indoor air or air in the clothing care room by means of the dehumidification path while the door closes the clothing care room.

The inflow path and the discharge path may each include a damper device arranged for opening or closing.

The inflow path may include an inflow path duct installed on a rear side of the door, and the damper device is arranged in the inflow path duct.

The door may include a condensate water guide arranged to guide condensate water, and at least a portion of the inflow path duct may include the condensate water guide.

The second circulation path may be included to circulate air in the clothing care room, and the second circulation path may include a wind blower device arranged to discharge air down or out of the clothing care room.

According to an embodiment of the disclosure, a clothing care system may have better dehumidification performance by enhancing a flow path structure.

Furthermore, dehumidification may be performed while a door is closed, thereby improving indoor dehumidification performance and improving the beauty of the appearance.

DETAILED DESCRIPTION

Figure 1:
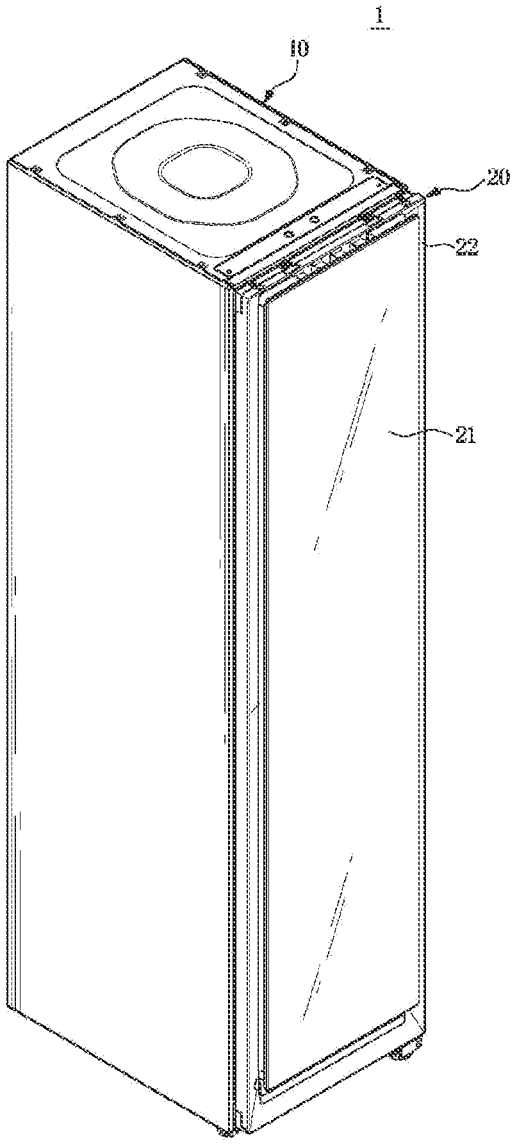
FIG. 1 is a perspective view of a clothing care system, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Reference will now be made in detail to embodiments, examples of which are illustrated in the accompanying drawings, wherein like reference numerals refer to the like elements throughout.

Figure 2:
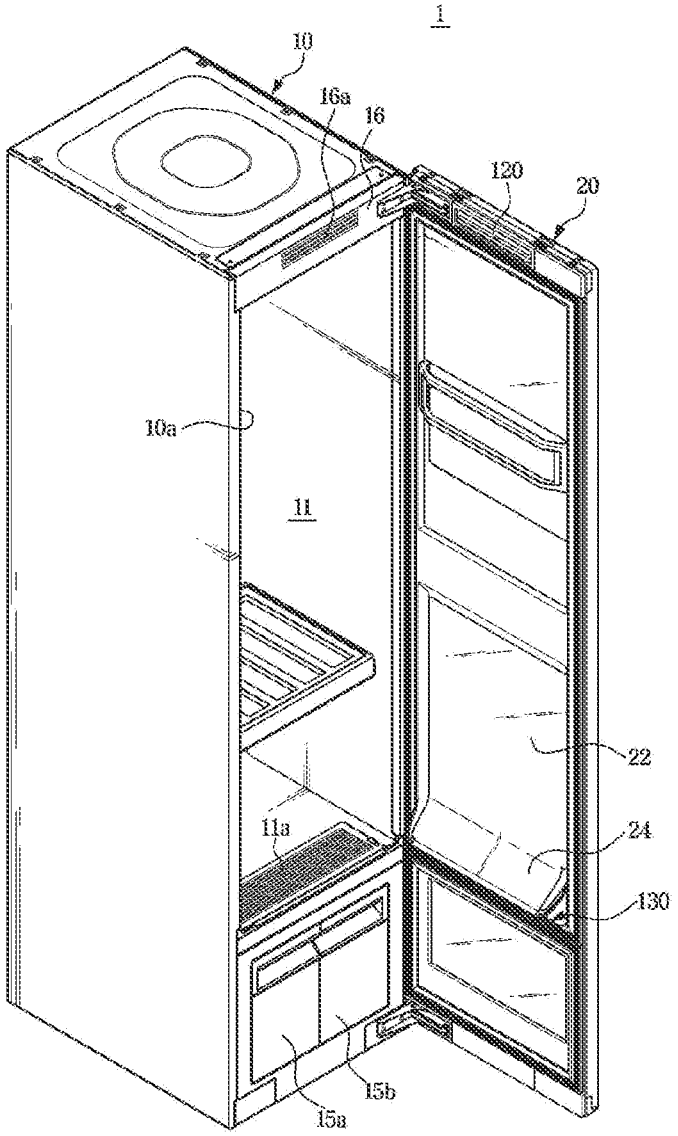
FIG. 2 shows a clothing care system with a door opened, according to an embodiment of the disclosure.
Figure 3:
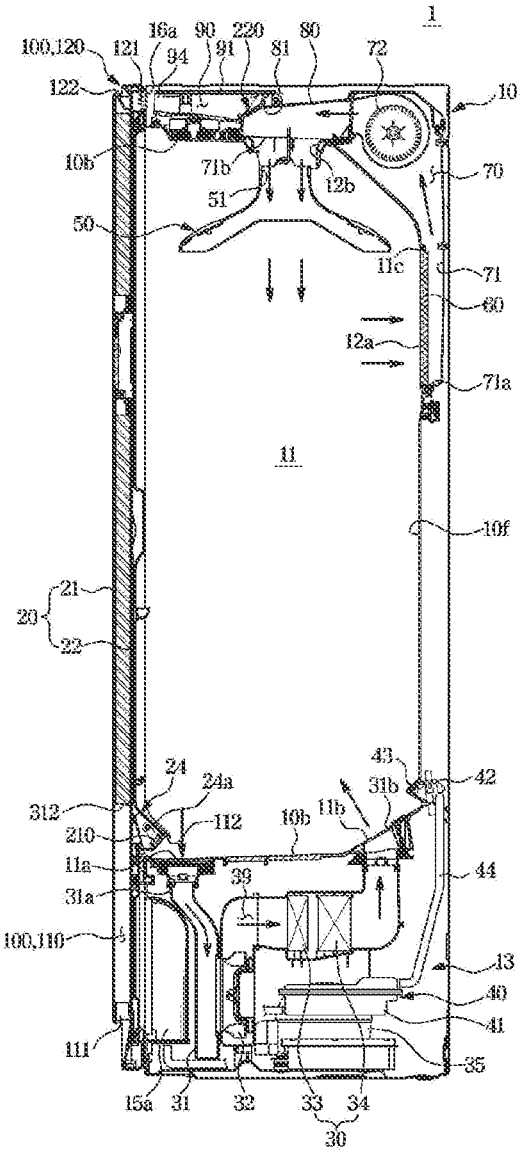
FIG. 3 is a side cross-sectional view illustrating a clothing care system, according to an embodiment of the disclosure.
Figure 4:
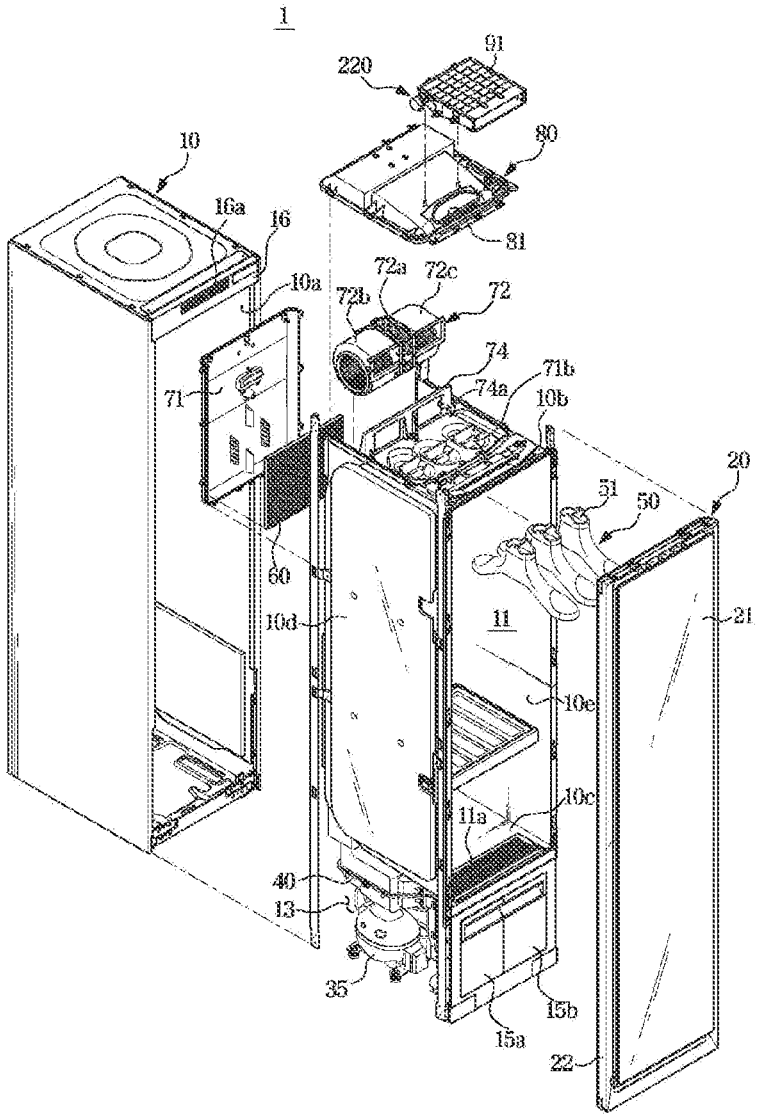
FIG. 4 is an exploded view of a clothing care system, according to an embodiment of the disclosure.

FIG. 1 is a perspective view of a clothing care system, according to an embodiment of the disclosure, FIG. 2 shows a clothing care system with a door opened, according to an embodiment of the disclosure, FIG. 3 is a side cross-sectional view illustrating a clothing care system, according to an embodiment of the disclosure, and FIG. 4 is an exploded view of a clothing care system, according to an embodiment of the disclosure.

As shown in FIGS. 1 to 4, a clothing care system 1 includes a main body 10 defining external appearance, a door 20 rotationally coupled to the main body 10, a clothing care room 11 for accommodating and taking care of clothes, a clothing support member 50 provided in the clothing care room 11 to have clothes hung thereon, and a machine room 13 equipped with a heat exchange device 30 provided to dehumidify or heat air in the clothing care room 11.

The main body 10 forms the clothing care room 11 inside, and may be shaped like a hexahedron with one side open. An opening 10*a* is formed on the front of the main body 10. The door 20 is installed at the opening 10*a* of the main body 10 to be rotationally coupled to the opening 10*a* for opening or closing the clothing care room 11. Although not shown, the door 20 may be installed with a coupling member such as a hinge, a link, etc.

The clothing care room 11 forms a space to accommodate clothes. The clothing care room 11 may be formed with a top side 10*b*, a bottom side 10*b*, a left side 10*c*, a right side 10*d*, and a rear side 10*f*. The front of the clothing care system 11 is formed to be opened. Accordingly, opening of the clothing care room 11 may also be opened or closed by the door 20 that opens or closes the opening 10*a* of the main body 10.

An outlet bracket 16 may be arranged at a top end of the opening 10*a* of the main body 10 in a position corresponding to the discharge path 120 of the door 20. The outlet bracket 16 may include a plurality of outlet slits 16*a* arranged to correspond to a discharge path 120 of the door 20.

A garment support member 50 is provided in the clothing care room 11 for clothes to be hung and supported thereon. The garment support member 50 may be installed on the top side 10*b* of the clothing care room 11. The garment support member 50 may be detachably installed in the clothing care room 11. There may be at least one or more garment support members 50. The garment support member 50 may be shaped like a hanger to hang a cloth.

The garment support member 50 is provided to allow air to move in the garment support member 50. Dust or foreign materials on the cloth may be removed by the air supplied into the garment support member 50. Air holes 51 may be formed at the garment support member 50 to supply air to the clothe. Although it is shown in the embodiment of the disclosure that the air holes 51 are formed at the top of the garment support member and air supplied through the air holes at the top is supplied to the inside and outside of the clothe as an example, the disclosure is not limited thereto.

For example, the air holes may be formed to have various sizes at various positions to widely spray the air, that is being supplied, across the clothe.

The clothing care room 11 may include a first air current inlet 11*a* and a second air current inlet 12*a*, a first air current outlet 11*b* and a second air current outlet 12*b*, and a steam outlet 43. The first air current inlet 11*a* and the first air current outlet 11*b* may be formed on the bottom side 10*b* of the clothing care room 11. The first air current inlet 11*a* may be arranged on a front portion of the bottom side 10*b* of the clothing care room 11. The first air current outlet 11*b* may be arranged on a rear portion of the bottom side 10*b* of the clothing care room 11.

The first air current inlet 11*a* and the first air current outlet 11*b* may be arranged close to each other.

The steam outlet 43 may be arranged in a lower portion of the rear side 10*f* the clothing care room 11. The steam outlet 43 may be arranged above the first air current outlet 11*b*.

The second air current inlet 12*a* may be formed on an upper portion of the rear side 10*f* the clothing care room 11. The second air current outlet 12*b* may be formed in the center of the top side 10*b* of the clothing care room 11. The second air current inlet 12*a* and the second air current outlet 12*b* may be arranged close to each other.

The second air current outlet 12*b* of the clothing care room 11 may be connected to the garment support member 50. Air discharged through the second air current outlet 12*b* is delivered to the garment support member 50 through the air hole 51 and then delivered to the clothe hung on the garment support member 50.

A drain tub 15*a* and a water supply tub 15*b* may be installed in a lower portion of the main body 10 to be detachable from the main body 10. The drain tub 15*a* and the water supply tub 15*b* may be arranged under the clothing care room 11. The drain tub 15*a* is provided to facilitate disposal of condensate water. Water required to generate steam in the steam generating device 40, which will be described later, may be stored in the water supply tub 15*b*. The water stored in the water supply tub 15*b* is supplied to the steam generating device 40 to be used to produce steam. The water supply tub 15*b* may be installed to be detachable from the main body 10 for easy water replenishment.

The drain tub 15*a* and the water supply tub 15*b* may be arranged in front of the machine room 13. The machine room 13 is arranged in a lower portion of the main body 10. The machine room 13 is arranged under the clothing care room 11. The machine room 13 may include the heat exchange device 30 provided to dehumidify and heat air in the clothing care room 11 as needed.

A wind blower fan 32, the heat exchange device 30, and the steam generating device 40 may be arranged in the machine room 13.

The heat exchange device 30 is installed to supply hot air into the clothing care room 11. The heat exchange device 30 includes an evaporator 33, a compressor 35, and a condenser 34 for circulation of a refrigerant, and is provided to dehumidify and heat air.

The refrigerant absorbs latent heat of surrounding air while evaporating in the evaporator 33 of the heat exchange device 30, condensing and eliminating moisture in the air. Furthermore, when the refrigerator is condensed in the condenser 34 via the compressor 35, the refrigerator radiates latent heat to surrounding air, thereby heating the surrounding air. That is, the evaporator 33 and the condenser 34 serve as a heat exchanger, so that air flowing into the machine room 13 due to the wind blower fan 32 sequentially passes the evaporator 33 and the condenser 34 to be dehumidified and heated.

The heat exchange device 30 installed in the machine room 13 may include a first duct 31 connecting between the evaporator 33, the condenser 34, and the wind blower fan 32, and the first duct 31 may be connected to the clothing care room 11 to form a first circulation path rotating between the clothing care room 11 and the first duct 31.

The first duct 31 may be connected to the first air current inlet 11*a* and the first air current outlet 11*b* of the clothing care room 11. The first duct 31 may have one end connected to the first air current inlet 11*a* of the clothing care room 11 and the other end connected to the first air current outlet 11*b* of the clothing care room 11. A first duct inlet 31*a* of the first duct 31 may be connected to the first air current inlet 11*a* and a first duct outlet 31*b* may be connected to the first air current outlet 11*b*.

The air in the clothing care room 11 flows into the first duct 31 through the first air current inlet 11*a*, in which the air is dehumidified, and released back into the clothing care room 11 through the first air current outlet 11*b*. Although it is shown in the embodiment of the disclosure that the first air current inlet is arranged in a front portion of the clothing care room and the first air current outlet is arranged in a rear portion of the clothing care room as an example, the disclosure is not limited thereto. For example, positions of the air current inlet and air current outlet may be variously changed as needed.

The first duct 31 is provided to dehumidify air flowing in through the first air current inlet 11*a* and release the air through the first air current outlet 11*b*. The wind blower fan 32 is arranged in the first duct 31 to suck air of the clothing care room 11 into the first duct 31.

The machine room 13 may further include the steam generating device 40 for generating steam from water supplied from the water supply tub 15*b*. The steam generating device 40 may be arranged in the machine room 13. The steam generating device 40 may include a steam generator 41 connected to the water supply tub 15*b* for receiving water therefrom to generate steam, and a steam supply pipe 44 for guiding the generated steam to a steam injector 42. The steam injector 42 may be arranged in a lower portion of the rear side of the clothing care room 11.

A heater (not shown) is installed inside the steam generator 41 to heat water.

The clothing care room 11 may include a wind blower device 72 for moving air in the clothing care room 11.

The clothing care room 11 may include a second duct 71, and the wind blower device 72 may be installed inside the second duct 71. A second circulation path 70 may be formed in the second duct 71 to be linked to the clothing care room 11 to rotate between the clothing care room 11 and the second duct 71. The wind blower device 72 may be arranged in the second circulation path 70.

The second duct 71 may be formed behind the second air current inlet 12*a* of the clothing care room 11. The second duct 71 may be arranged in an upper portion of the rear side of the clothing care room 11, and may include a filter member 60 inside. The second duct 71 may be coupled to a top cover 80 arranged on the top of the clothing care room 11. The second duct 71 may be coupled to the top cover 80, and have the wind blower device 72 installed therein. The wind blower device 72 may be arranged above and behind the clothing care room 11, and may include a wind blower motor 72*a* for generating rotational force and at least one wind blower fan 72*b* rotated by the wind blower motor. The wind blower fan 72*b* may be accommodated by a fan case 72*c*. The fan case 72*c* may be coupled to the duct bracket 74 arranged at the top side 10*b* of the clothing care room 11. At least one duct hole 74*a* is formed at the duct bracket 74, and the at least one duct hole 74*a* is coupled to the respective wind blower fan 72*b* to move air in the second duct 71 to the second air current outlet 12*b* of the second duct 71.

The second duct 71 may be connected to the second air current inlet 12*a* and the second air current outlet 12*b* of the clothing care room 11. The second duct 71 may have one end connected to the second air current inlet 12*a* of the clothing care room 11 and the other end connected to the second air current outlet 12*b* of the clothing care room 11. A second duct inlet 71*a* of the second duct 71 may be connected to the second air current inlet 12*a* and a second duct outlet 71*b* may be connected to the second air current outlet 12*b*.

The second air current outlet 12*b* of the clothing care room 11 may be formed in a position corresponding to the second duct outlet 71*b* of the second duct 71.

The second duct outlet 71*b* of the second duct 71 is connected to the second air current outlet 12*b* of the clothing care room 11, and the second air current outlet 12*b* is connected to the garment support member 50, allowing the air in the second duct 71 to delivered to the garment support member 50.

The wind blower device 72 arranged inside the second duct 71 sucks in air in the clothing care room 11 through the second air current inlet 12*a* and releases the air through the second duct outlet 71*b* and the second air current outlet 12*b*.

The filter member 60 is arranged in the second air current inlet 12*a* of the clothing care room 11. The second air current inlet 12*a* is formed on the rear side 10*f* of the clothing care room 11. A filter member installation part 11*c* is arranged on the rear side 10*f* of the clothing care room 11 for the filter member 60 to be installed therein. The second air current inlet 12*a* may be formed in a position corresponding to the filter member installation part 11*c*.

When the air in the clothing care room 11 flows into the second duct 71, the air may be filtered by the filter member 60 at the second air current inlet 12*a* The air flowing into the second duct 71 may be dusted and deodorized by the filter member 60. The air filtered by the filter member 60 may be released to the second duct outlet 71*b* and the garment support member 50 by means of the wind blower device 72.

The filter member 60 may include a dust collecting filter (not shown) for eliminating dust or a means for deodorization.

Hence, to take care of a clothe, the clothing care room 11 hangs the cloth on the garment support member 50 and operates while the door 20 is closed 20. In this case, air is circulated along the first circulation path 39 and the second circulation path 70 in the clothing care room 11.

The clothing care system 1 includes a dehumidification path 100 arranged at the door 20 to connect the clothing care room 11 to the outside during indoor dehumidification. The dehumidification path 100 may be arranged in the door 20. At least one or more dehumidification paths 100 may be formed.

Figure 5:
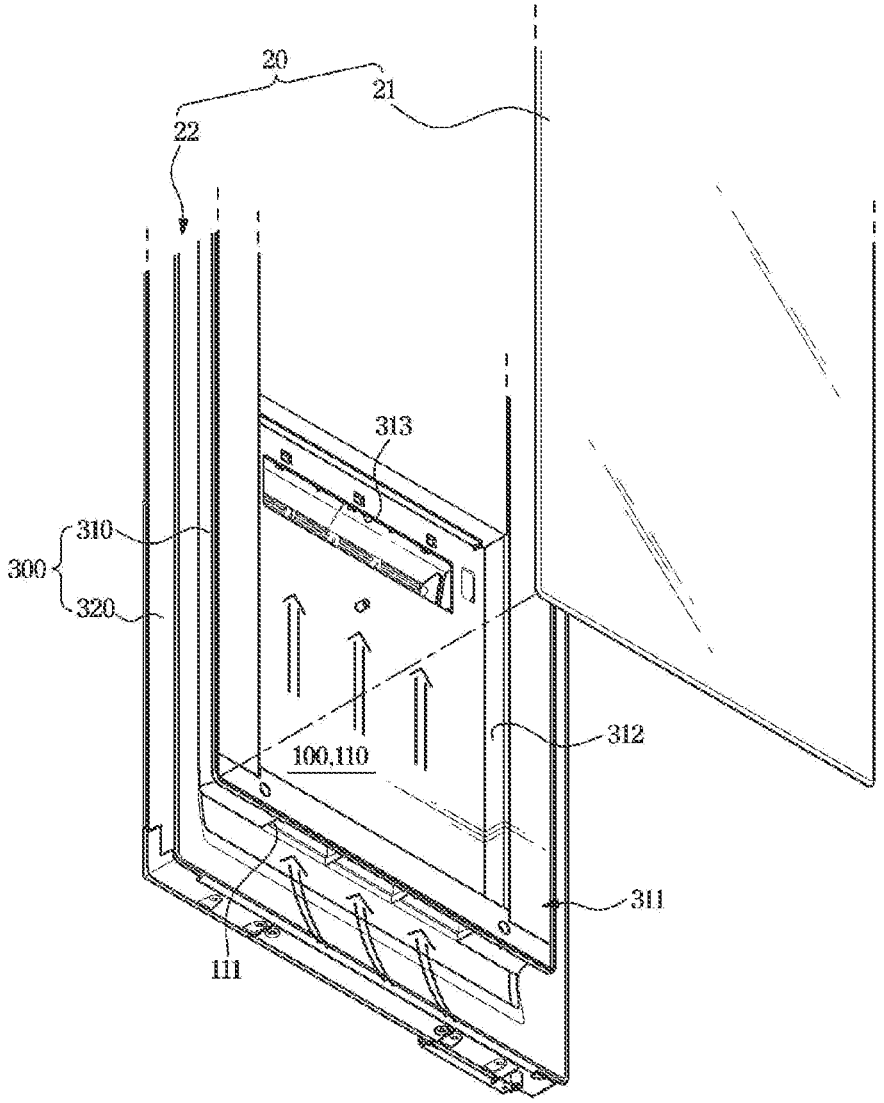
FIG. 5 is a partial exploded view illustrating a dehumidification path of a door of a clothing care system, according to an embodiment of the disclosure.
Figure 6:
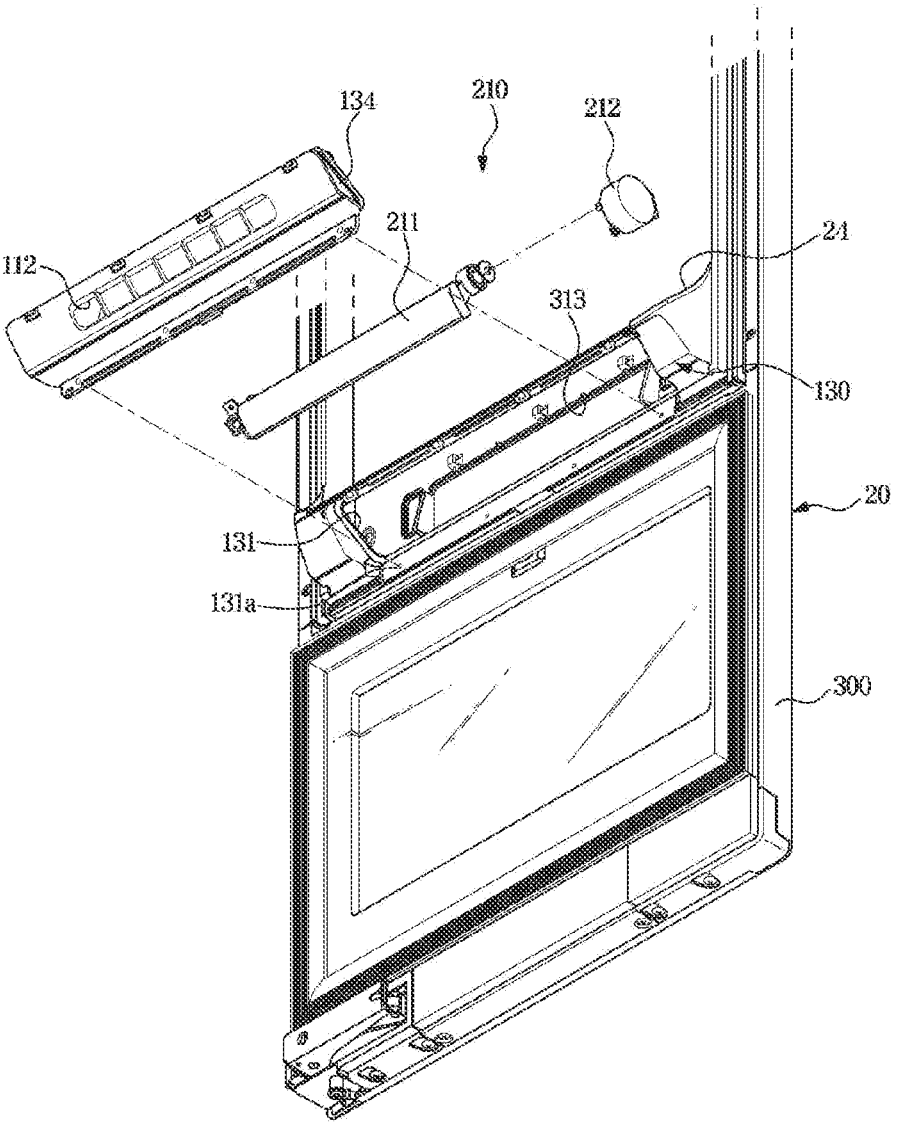
FIG. 6 is a partial exploded view illustrating a damper device in an inflow path, according to an embodiment of the disclosure.

FIG. 5 is a partial exploded view illustrating a dehumidification path of a door of a clothing care system, according to an embodiment of the disclosure, and FIG. 6 is a partial exploded view illustrating a damper device in an inflow path, according to an embodiment of the disclosure. Reference numerals not shown may be referred to from FIGS. 1 to 4.

As shown in FIGS. 5 and 6, the door 20 may include the dehumidification path 100 that links the clothing care room 11 to the outside.

The door 20 includes a first door member 21 forming the front side, and a second door member 22 coupled to the first door member 21 to form the rear side.

The dehumidification path 100 may be formed between the first door member 21 and the second door member 22. At least one dehumidification path 100 may be formed between the first door member 21 and the second door member 22. The dehumidification path 100 may be formed on at least one of the first door member 21 and the second door member 22.

The dehumidification path 100 may include an inflow path 110 to bring outside air into the clothing care room 11, and a discharge path 120 to discharge air inside the clothing care room 11 to the outside, the inflow path 110 and the discharge path 120 being arranged at the door 20.

The first door member 21 is formed in the shape of a plate. The first door member 21 may include a mirror, glass, a panel, etc. Although it is shown in the embodiment of the disclosure that the first door member 21 is a mirror shaped like a plate as an example, the disclosure is not limited thereto. For example, the first door member may include a cover of various materials coupled to have a sense of unity with e.g., furniture in a space where the clothing care system 1 is installed.

The first door member 21 may be installed in front of the second door member 22 to define the appearance of the clothing care system 1.

The second door member 22 may include a first door member installation part 311 to have the first door member 21 installed thereon. The first door member installation part 311 may be placed in front of the second door member 22.

The second door member 22 may further include a door frame 300. The door frame 300 may include a first door frame 310 and a second door frame 320 coupled to the rear side of the second door frame 320. The first door member installation part 311 may be arranged on the front of the first door frame 310.

The dehumidification path 100 may be arranged on the first door frame 310. The inflow path 110 may be arranged on the first door frame 310.

The inflow path 110 is arranged for the air flowing in through a first inlet 111 to be moved and released into the clothing care room 11 through a first outlet 112.

The inflow path 110 may include an inflow path duct 130 to guide the air flowing in through the first inlet 111 to be moved. The first outlet 112 may be formed in the inflow path duct 130.

The inflow path 110 may include a first damper device 210 provided to open or close the first outlet 112. The first damper device 210 may be arranged in the inflow path duct 130.

The first inlet 111 is arranged on at least one side of the first door frame 310 to bring in outside air. The first inlet 111 is formed on the bottom side of the first door frame 310. The first inlet 111 may be formed in the plural. An air current inflow space 312 may be formed between the first door frame 310 and the first door member 21 to accommodate air flowing in through the first inlet 111. An air current inflow hole 313 may be formed in the air current inflow space 312. The air current inflow hole 313 may be formed at the first door frame 310.

The second door frame 320 may be formed in the size and shape corresponding to the opening 10*a* of the main body 10. The second door frame 320 may be arranged to be in contact with the main body 10 to open or close the opening 10*a*.

The dehumidification path 100 may be arranged on the second door frame 320. The inflow path 110 may be arranged on the first door frame 310. The inflow path duct 130 of the inflow path 110 may be arranged on the second door frame 320. The inflow path duct 130 may be installed in a position corresponding to the air current inflow hole 313 of the first door frame 310.

Outside air flowing in through the first inlet 111 of the first door frame 310 is delivered to the inflow path duct 130 through the air current inflow space 312 and the air current inflow hole 313.

The inflow path duct 130 is installed on the second door frame 320. The inflow path duct 130 may be installed on the rear side of the second door frame 320. The inflow path duct 130 may include an inflow path duct cover 134. The inflow path duct cover 134 is coupled onto at least one side of the inflow path duct 130. The inflow path duct 130 may include a duct cover installation part 131 to have the inflow path duct cover 134 installed therein.

A duct cover fixer 131*a* may be provided at the duct cover installation part 131 to install and fix the inflow path duct cover 134. The inflow path duct cover 134 may be coupled to the duct cover installation part 131 by screwing or hooking.

The first outlet 112 may be arranged at the inflow path duct cover 134 to discharge air of the inflow path 110. The air flowing into the inflow path 110 through the first inlet 111 may be released into the clothing care room 11 through the first outlet 112. Although it is shown in the embodiment of the disclosure that the first outlet is formed at the inflow path duct cover as an example, the disclosure is not limited thereto. For example, the first outlet may be integrally formed with the second door member.

The inflow path duct 130 includes a first damper device 210 arranged to open or close the first outlet 112. The first damper device 210 includes a first flow path open/close member 211 arranged for opening or closing the first outlet 112, and a first motor 212 provided to rotate the first flow path open/close member 211.

The first flow path open/close member 211 may be formed in the shape of a board. The first flow path open/close member 211 may be formed in a shape corresponding to the first outlet 112. The first flow path open/close member 211 may be installed to be rotated by the first motor 212.

The door 20 may include a condensate water guide 24 for guiding movement of condensate water. The condensate water guide 24 is arranged to be able to guide condensate water formed by being condensed on the rear side of the door 20. The condensate water guide 24 may include a curved part 24*a* formed to incline from the second door frame 320 toward the clothing care room 11.

The curved part 24*a* of the condensate water guide 24 may include at least one side of the inflow path duct 130. The curved part 24*a* of the condensate water guide 24 may form the top side of the inflow path duct 130.

Figure 7:
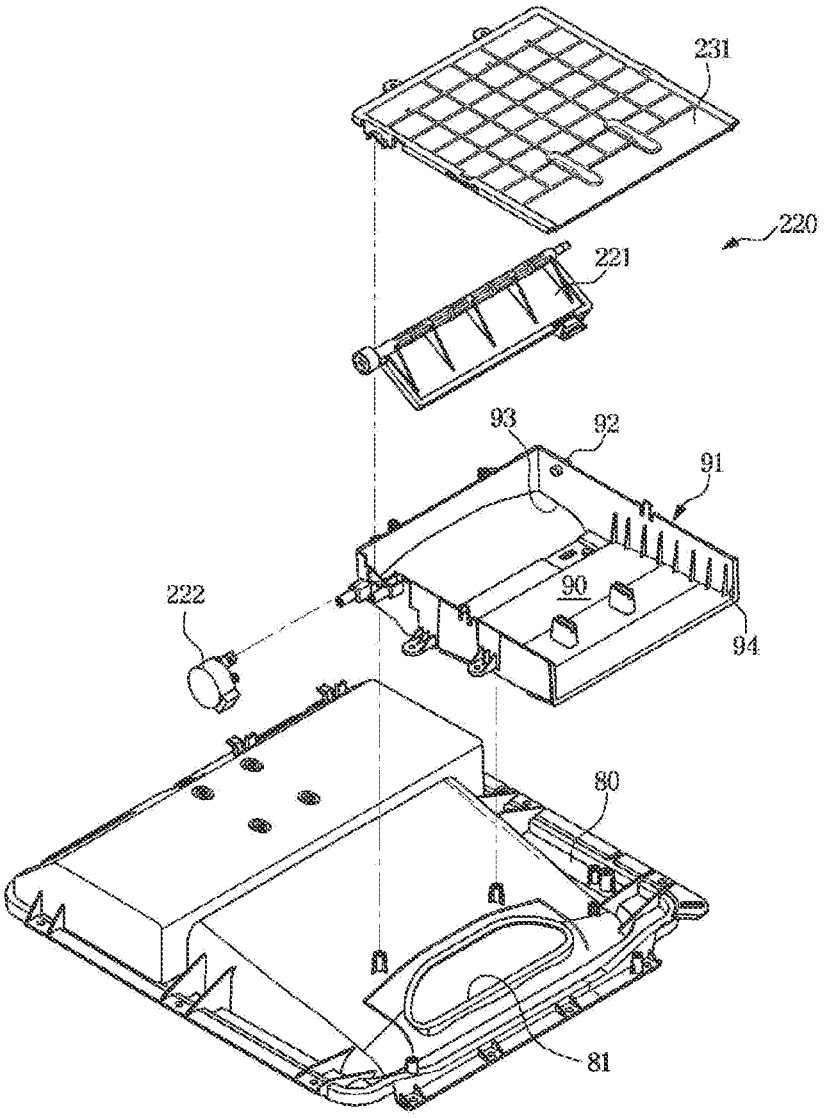
FIG. 7 is a partial exploded view illustrating a connection flow path, according to an embodiment of the disclosure.
Figure 8:
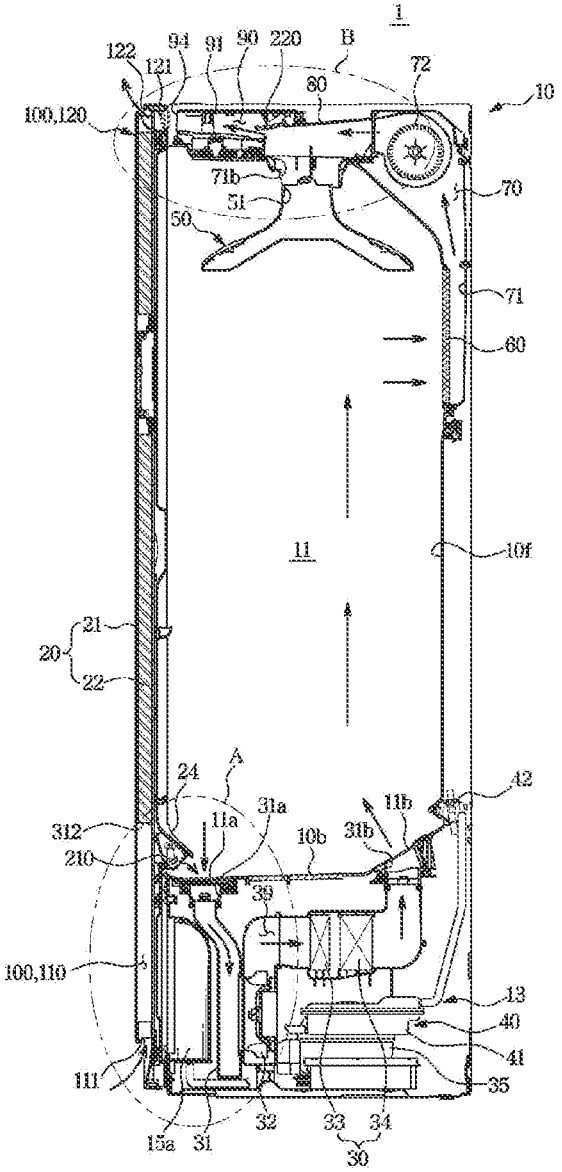
FIG. 8 shows air flows during dehumidification of a clothing care system, according to an embodiment of the disclosure.
Figure 9:
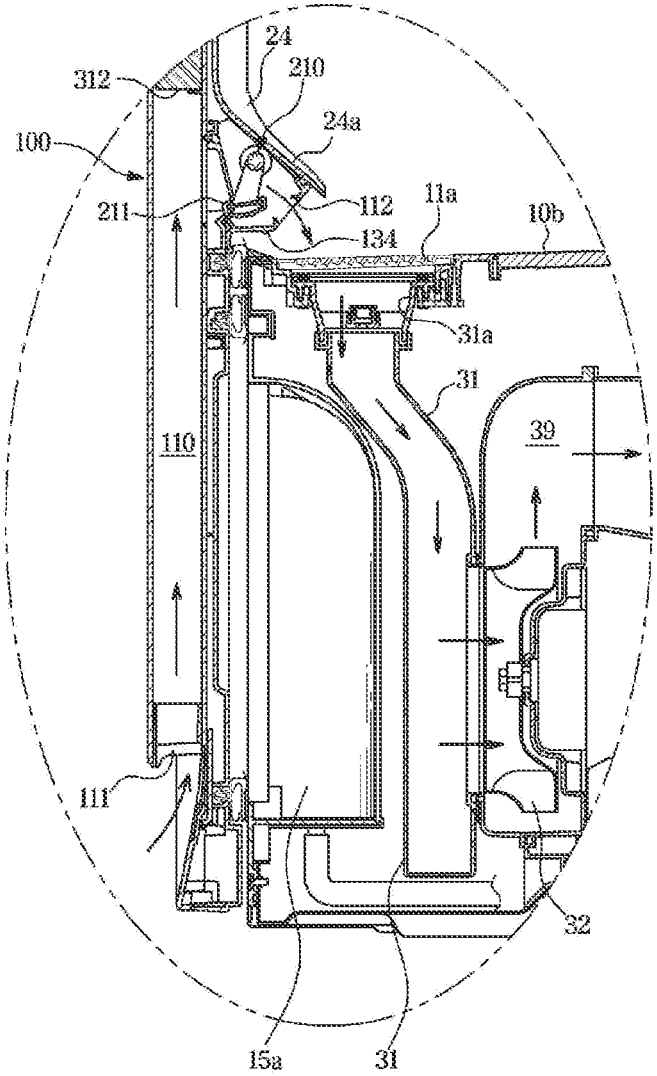
FIG. 9 is an enlarged view of part A of FIG. 8, illustrating an inflow path of a door, according to an embodiment of the disclosure.
Figure 10:
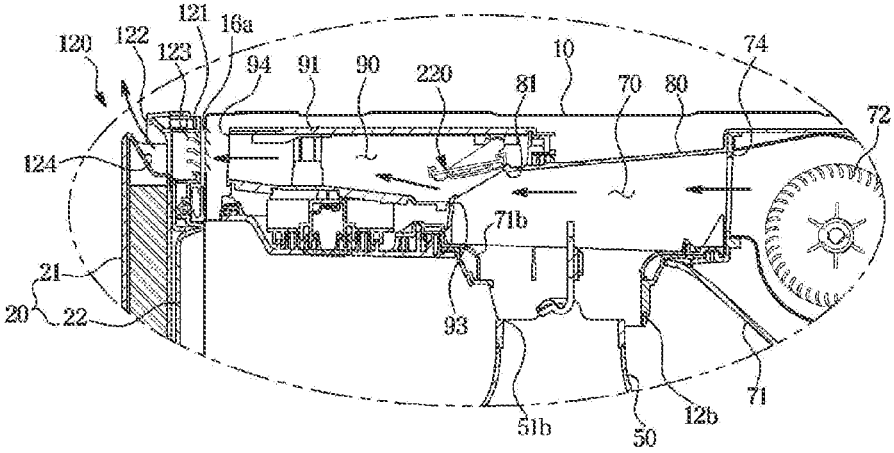
FIG. 10 is an enlarged view of part B of FIG. 8, illustrating a discharge path of a door, according to an embodiment of the disclosure.

FIG. 7 is a partial exploded view illustrating a connection flow path, according to an embodiment of the disclosure, FIG. 8 shows air flows during dehumidification of a clothing care system, according to an embodiment of the disclosure, FIG. 9 is an enlarged view of part A of FIG. 8, illustrating an inflow path of a door, according to an embodiment of the disclosure, and FIG. 10 is an enlarged view of part B of FIG. 8, illustrating a discharge path of a door, according to an embodiment of the disclosure. Reference numerals not shown may be referred to from FIGS. 1 to 4.

As shown in FIGS. 7 to 10, at least one dehumidification path 100 may be provided at the door 20 to enable the clothing care room 11 to be linked to the outside. The dehumidification path 100 may include the discharge path 120 for discharging air in the clothing care room 11 to the outside. The discharge path 120 may be arranged at the door 20. The discharge path 120 may be arranged on the first door frame 310 of the door 20.

The discharge path 120 is arranged for air flowing in through the second inlet 121 to be moved and discharged out of the clothing care room 11 through the second outlet 122.

The discharge outlet 120 is arranged at the door 20 to discharge the air inside the clothing care room 11 to the outside. Although it is shown in the embodiment of the disclosure that the first door frame and the second door frame are separately provided and then combined as an example, the disclosure is not limited thereto. For example, the first door frame and the second door frame may be integrally formed.

To deliver the air in the clothing care room 11 to the discharge path 120, the main body 10 further includes a connection flow path 90 connecting between the second circulation path 70 and the discharge path 120.

The connection flow path 90 may be arranged at the top cover 80 provided on the top of the clothing care room 11. The connection flow path 90 may be formed by being connected to the second circulation path 70. The connection flow path 90 may be formed by being branched from the second circulation path 70.

The connection flow path 90 may include a connection duct 91. The connection flow path 90 may be formed in the connection duct 91. The connection duct 91 may be coupled to the top cover 80. The connection flow path 90 may be formed when the connection duct 91 is coupled to the top cover 80. The top cover 80 includes a connection flow path hole 81. The connection flow path hole 81 may be formed in front of the top cover 80. The connection duct 91 is formed to be connected to the connection flow path hole 81 of the top cover 80. The connection duct 91 has a connection duct hole 74*a* formed therein to correspond to the connection flow path hole 81. The connection duct hole 74*a* of the connection duct 91 is connected to the connection flow path hole 81 of the top cover 80. The connection duct 91 is shaped like a hexahedron with open top and open front, and the connection duct cover 231 may be coupled to the open top.

A connection duct outlet 94 connected to the opening 10*a* of the main body 10 is formed on the front of the connection duct 91. The connection duct outlet 94 is formed on the front of the connection duct 91, so that air of the second circulation path 70 flows into the connection flow path 90 through the connection duct hole 74*a* and moves to the opening 10*a* of the main body 10 through the connection duct outlet 94.

A second damper device 220 is arranged in the connection duct 91 to open or close a connection with the second circulation path 70. The second damper device 220 is formed to open or close the connection flow path hole 81 of the top cover 80. The second damper device 220 includes a second flow path open/close member 221 arranged to open or close the connection flow path hole 81, and a second motor 222 provided to rotate the second flow path open/close member 221.

The second flow path open/close member 221 may be formed in the shape of a board. The second flow path open/close member 221 may be formed in a shape corresponding to the connection flow path hole 93. The second flow path open/close member 221 may be installed to be rotated by the second motor 222. The second flow path open/close member 221 may be rotationally installed at an open/close installation part 92 of the connection duct 91. The second flow path open/close member 221 may be arranged to be able to open or close the connection flow path hole 93. The second flow path open/close member 221 is arranged between the second circulation path 70 and the connection flow path 90 for selectively moving air in the clothing care room 11, that is flowing from the second circulation path 70, to the opening 10*a* of the main body 10.

The connection duct outlet 94 of the connection duct 91 may be formed to correspond to the humidification path 100 formed at the door 20. The connection duct outlet 94 may be formed to correspond to the discharge path 120 of the door 20. The connection duct outlet 94 may be formed in a position corresponding to the second inlet 121 of the discharge path 120. The connection duct outlet 94 may be arranged to be connected to the second inlet 121 of the discharge path 120.

As shown in FIG. 10, the discharge path 120 includes the second inlet 121, and the second outlet 122 formed to discharge the air of the clothing care room 11, that is flowing in through the second inlet 121, to the outside of the main body 10 and the door 20.

The second inlet 121 is arranged at the second door member 22 of the door 20. The second inlet 121 is arranged on the top of the second door member 22. The second inlet 121 is formed on the rear side of the second door member 22. The second inlet 121 is formed in a position corresponding to the connection duct outlet 94 of the connection duct 91. Air in the second circulation path 70 flowing in through the second inlet 121, i.e., the air in the clothing care room 11, is discharged through the second outlet 122. The second outlet 122 is arranged on the top of the door 20. The second outlet 122 is formed on the top of the second door member 22. The second inlet 121 and the second outlet 122 are formed to be linked to each other. The discharge path 120 formed between the second inlet 121 and the second outlet 122 may include a discharge guide 123 for guiding air to be discharged through the second outlet 122. At least one or multiple discharge guides 123 are formed. The discharge guide 123 is formed to guide air flowing in through the second inlet 121 to the second outlet 122. The discharge path 120 may further include a discharge path guide 124 formed at the second door frame 22. The discharge path guide 124 may be formed at a top end of the second door member 22. The air flowing into the discharge path 120 through the second inlet 121 is guided by the discharge path guide 124 and discharged to the outside of the door 20. Air of the clothing care room 11 flowing into the second circulation path 70 may be discharged to the outside of the main body 10 through the connection flow path 90 and the door 20, during dehumidification of the clothing care room 11. In an embodiment of the disclosure, during a dehumidifying operation of the clothing care system 1, the clothing care room 11 of the main body 10 may be linked to an indoor room through the dehumidification path 100 arranged at the door 20.

An indoor dehumidifying operation by means of the dehumidification path 100 of the clothing care system 1 will now be described.

During a dehumidifying operation of the clothing care system 1, the user may select dehumidification hours while the door 20 is closed on the main body 10.

When the user selects a desired period of time and start dehumidification, the first damper device 210 and the second damper device 220 of the clothing care system 1 are opened.

The first damper device 210 opens the first inlet 111 formed in the inflow path 110 of the door 20. The second damper device 220 opens the connection flow path hole 81 of the connection flow path 90. As the connection flow path hole 81 is opened, the second circulation path 70 and the connection flow path 90 are linked to each other.

The wind blower fan 32 arranged in the first circulation path 39 and the second wind blower device 72 of the second circulation path 70 are separately operated.

Air of the clothing care room 11 flowing in through the first duct 31 of the first circulation path 39 is dehumidified and heated by the heat exchange device 30 and released into the clothing care room 11.

The air released into the clothing care room 11 flows into the second circulation path 70 by the second wind blower device 72. At this time, the air is filtered by the filter member 60.

The air filtered by the filter member 60 is discharged into the discharge path 120 of the door 20 through the connection flow path 90 connected to the second circulation path 70.

The door 20 is provided to be linked to the outside of the clothing care room 11 through the inflow path 110 and the discharge path 120, thereby performing dehumidification of the clothing care room 11 and indoor dehumidification at the same time while the door 20 is not opened from the main body 10. In this case, the door 20 remains closed on the main body 10, so the beauty of the appearance may be enhanced and the operating noise may also be reduced.

Furthermore, several hours of circulation of the air purified by the filter member 60 may purify indoor air, and as the purified air is used for clothing care, clothing care efficiency may be improved.

After the hours of the air circulation set by the user, the dehumidifying operation is terminated by stopping operation of the wind blower fan 32 and the wind blower device 72 and closing the first damper device 210 and the second damper device 220.

Although it is described in the embodiment of the disclosure that certain dehumidification hours are set for a dehumidifying operation as an example, the disclosure is not limited thereto. For example, the user may start dehumidification by setting a desired humidity level.

Several embodiments of the disclosure have been described above, but a person of ordinary skill in the art will understand and appreciate that various modifications can be made without departing from the scope of the disclosure. Thus, it will be apparent to those or ordinary skill in the art that the true scope of technical protection is only defined by the following claims.

The invention claimed is:

1. A clothing care system comprising:

a main body including a clothing care room with an open front;

a heat exchange device equipped in the main body and arranged to exchange heat with air in the clothing care room; and a door arranged to open or close the open front of the main body, wherein the door comprises at least one dehumidification path allowing the clothing care room to be linked to outside, wherein the dehumidification path comprises an inflow path arranged to bring outside air through the door into the clothing care room, and a discharge path arranged to discharge air in the clothing care room to an outside through the door, and wherein the dehumidification path comprises a first circulation path arranged for air in the clothing care room to exchange heat with the heat exchange device and to be released into the clothing care room, and a second circulation path arranged for air in the clothing care room to be filtered by a filter member and released into the clothing care room.

2. The clothing care system of claim 1, wherein the inflow path is arranged to release air, which flows into the door through a first inlet, into the clothing care room through a first outlet, and comprises a first damper device arranged to open or close the first outlet.

3. The clothing care system of claim 2, wherein the first damper device comprises a first flow path open/close member arranged inside the inflow path and arranged to open or close the first outlet, and a first motor arranged to rotate the first flow path open/close member.

4. The clothing care system of claim 1, wherein the second circulation path comprises a wind blower device arranged to discharge air down or out of the clothing care room.

5. The clothing care system of claim 1, wherein the main body comprises a connection flow path arranged by being branched from the second circulation path to connect the second circulation path to the discharge path.

6. The clothing care system of claim 5, wherein the connection flow path is arranged between the second circulation path and the open front of the main body.

7. The clothing care system of claim 6, wherein the connection flow path comprises a second damper device arranged to be able to open or close a connection with the second circulation path.

8. The clothing care system of claim 6, wherein the discharge path is arranged to discharge air of the second circulation path, which is delivered to the connection flow path, out of the clothing care room through a second inlet and a second outlet.

9. The clothing care system of claim 8, wherein the second inlet is formed in a position corresponding to the connection flow path.

10. The clothing care system of claim 1, wherein the door comprises a first door member forming a front side, and a second door member coupled with the first door member and forming a rear side, and wherein the dehumidification path is arranged between the first door member and the second door member.

11. The clothing care system of claim 10, wherein the inflow path comprises an inflow path duct installed on a rear side of the second door member.

12. The clothing care system of claim 11, wherein the second door member comprises a condensate water guide arranged to guide condensate water, and wherein at least a portion of the inflow path duct comprises the condensate water guide.

13. The clothing care system of claim 1, further comprising: a garment support member equipped in the clothing care room and arranged to support a clothing garment, wherein the second circulation path is linked to the garment support member.

* * * * *